US006983570B2

(12) United States Patent
Mead

(10) Patent No.: US 6,983,570 B2
(45) Date of Patent: Jan. 10, 2006

(54) TOP LEVELLED ACCESS FLOOR SYSTEM

(75) Inventor: Bruce Mead, Mississauga (CA)

(73) Assignee: ASM Modular Systems Ltd., Mississauga (CA)

( * ) Notice: Subject to any disclaimer, the term of this patent is extended or adjusted under 35 U.S.C. 154(b) by 196 days.

(21) Appl. No.: 10/617,112

(22) Filed: Jul. 11, 2003

(65) Prior Publication Data

US 2005/0005547 A1 Jan. 13, 2005

(51) Int. Cl.
*E04B 5/00* (2006.01)

(52) U.S. Cl. ..... 52/263; 52/126.5; 52/126.6; 52/126.7; 248/188.2; 248/188.3; 248/188.4; 248/354.3; 248/354.4

(58) Field of Classification Search ..... 52/126.5, 52/126.6, 126.7, 263, 385; 248/188.4, 188.2, 248/188.3, 357, 354.3, 354.4
See application file for complete search history.

(56) References Cited

U.S. PATENT DOCUMENTS 4,113,219 A 9/1978 Mieyal
4,447,998 A 5/1984 Griffin
4,558,544 A * 12/1985 Albrecht et al. ..... 52/126.6
4,578,910 A 4/1986 Germeroth et al.
4,637,181 A 1/1987 Cohen
4,780,571 A * 10/1988 Huang ..... 174/48
4,850,162 A 7/1989 Albrecht
4,901,490 A 2/1990 Zinniel et al.
4,930,270 A 6/1990 Bevacqua
4,942,708 A 7/1990 Krumholz et al.
4,966,804 A * 10/1990 Hasegawa et al. ..... 428/203
5,046,291 A 9/1991 Narayan
5,072,557 A * 12/1991 Naka et al. ..... 52/126.6
5,228,252 A 7/1993 Nehls
5,333,423 A * 8/1994 Propst ..... 52/126.6
5,791,096 A * 8/1998 Chen ..... 52/126.6
6,363,685 B1 * 4/2002 Kugler ..... 52/745.05
6,442,906 B1 * 9/2002 Hwang ..... 52/126.6

* cited by examiner

*Primary Examiner*—Jeanette Chapman
(74) *Attorney, Agent, or Firm*—Eugene J. A. Gierczak

(57) ABSTRACT

A pedestal adapted to support a floor panel comprising a base, support means for supporting said floor panel above said base, displaceable means operable between said base and said support means for selectively displacing said support means and said floor panel relative to said base so as to level said floor panel while said floor panel is supported by said support means.

18 Claims, 6 Drawing Sheets

TOP LEVELLED ACCESS FLOOR SYSTEM

FIELD OF INVENTION

This invention relates to pedestals adapted to support a floor panel, and particularly relates to pedestals for supporting the corners of adjacent floor panels to level the floor panels while said floor panels are supported by the pedestals. More specifically, the invention relates to pedestals permitting height adjustment of the floor panels by tools accessed from above the floor panels. This invention also relates to the method of levelling floor panels by tools capable of adjusting the height and level of pedestals from above the floor panels.

BACKGROUND OF THE INVENTION

Elevated floor structures have gained much prominise with the advent of computer systems. Such elevated floor structures consists of floors constructed by arranging generally rectangular panels in side-by-side or adjacent fashion into a rectangular array. Generally speaking such panels are supported at their corners by regularly spaced pedestals which in turn are supported on a subfloor. Space between the subfloor and panel floor is available for utility lines, air ducts, computer wire or the like. These panels can be individually removed for servicing.

Generally speaking such prior art pedestal access floor systems need to be levelled. Such prior art levelling devices and systems generally consist of attempting to level the pedestal and floor systems by adjusting from below the floor system prior to placing the floor panels onto the pedestals.

For example, U.S. Pat. No. 5,228,252 relates to a floor panel having pedestals which support the raised floor. Furthermore, U.S. Pat. No. 5,046,291 illustrates a panel resting upon an upper base, while U.S. Pat. No. 4,901,490 relates to a grid support pedestal which includes a metallic hollow pedestal tube secured to a metallic base plate which rests on the sub floor.

Moreover, U.S. Pat. No. 4,850,152 relates to a pedestal column which is threaded having a pedestal adjusting nut.

Finally, U.S. Pat. No. 4,578,910 relates to a system for interlocking the edges and corners of adjacent panels of a pedestal supported elevated floor construction.

These and other prior art systems generally describe complicated structures which are awkward to level the access floor system. Furthermore, such systems must generally be adjusted below the floor panels.

It is an object of this invention to provide a relatively simple structure which is easy to use. It is a further object of this invention to provide an access floor system that can be levelled after the panels have been installed.

It is an aspect of this invention to provide a pedestal adapted to support a floor panel comprising: a base; support structure for supporting said floor panel above said base; and displaceable structure operable between said base and said support structure for selectively displacing said support structure and said floor panel relative said base so as to level said floor panel while said floor panel is supported by said support structure.

It is a further aspect to provide a pedestal for supporting the corners of adjacent floor panels comprising: a base; first and second threadably engageable members extending generally coaxially relative said base; one of said first and second threaded members including: a support extending generally radially outwardly for supporting said corners of said floor panels; engageable structure adapted for threaded rotation of said first threaded member relative said second threaded member so as to select the height of said support relative said base and level said floor panels while said floor panels are supported by said support.

It is yet another aspect of this invention to provide a method of levelling floor panels supported by pedestals at adjacent corners of said floor panels comprising of the steps of positioning said pedestals having telescoping threaded members at the corners of said adjacent floor panels for support said floor panels; accessing said telescoping threaded members by tools capable of threadedly adjusting the height of said telescoping threaded members from above said floor panels.

These and other objects and features of the inventions shall now be described in relation to the following drawings.

DRAWINGS

Figure 5:
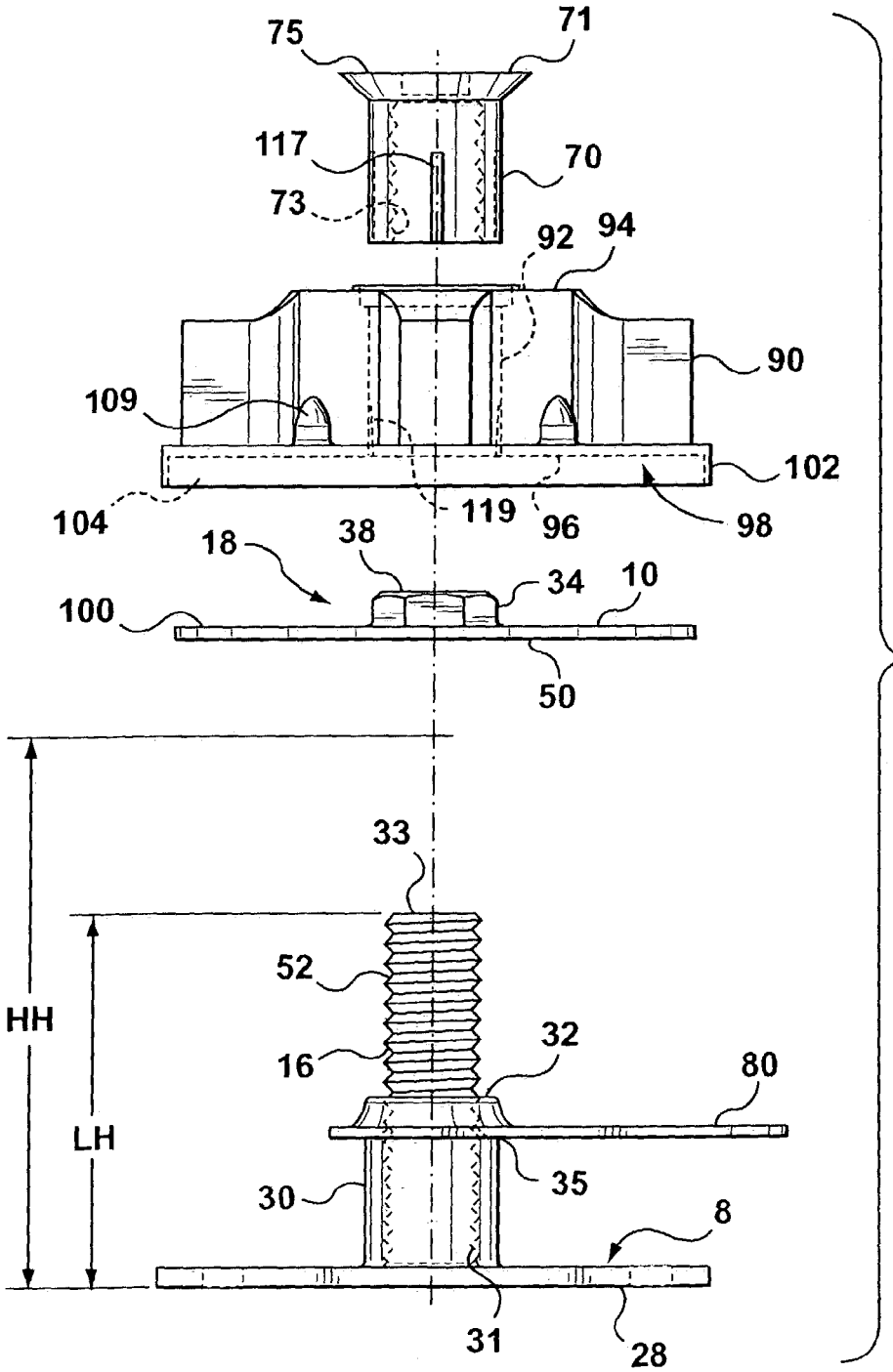
FIG. 5 is an exploded cross sectional view of a second embodiment of the invention.
Figure 5A:
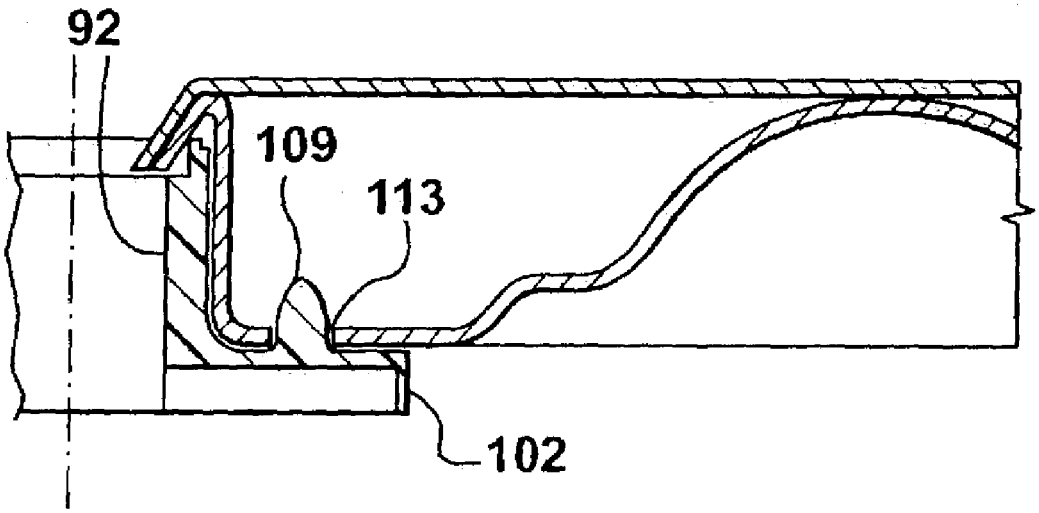

FIG. 5*a* is a partial section of the floor panel with the support guide.

Figure 6:
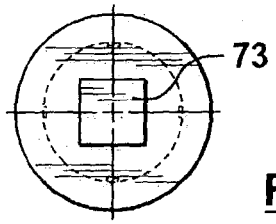

FIG. 6 is a top plan view of the locking cap.

Figure 7:
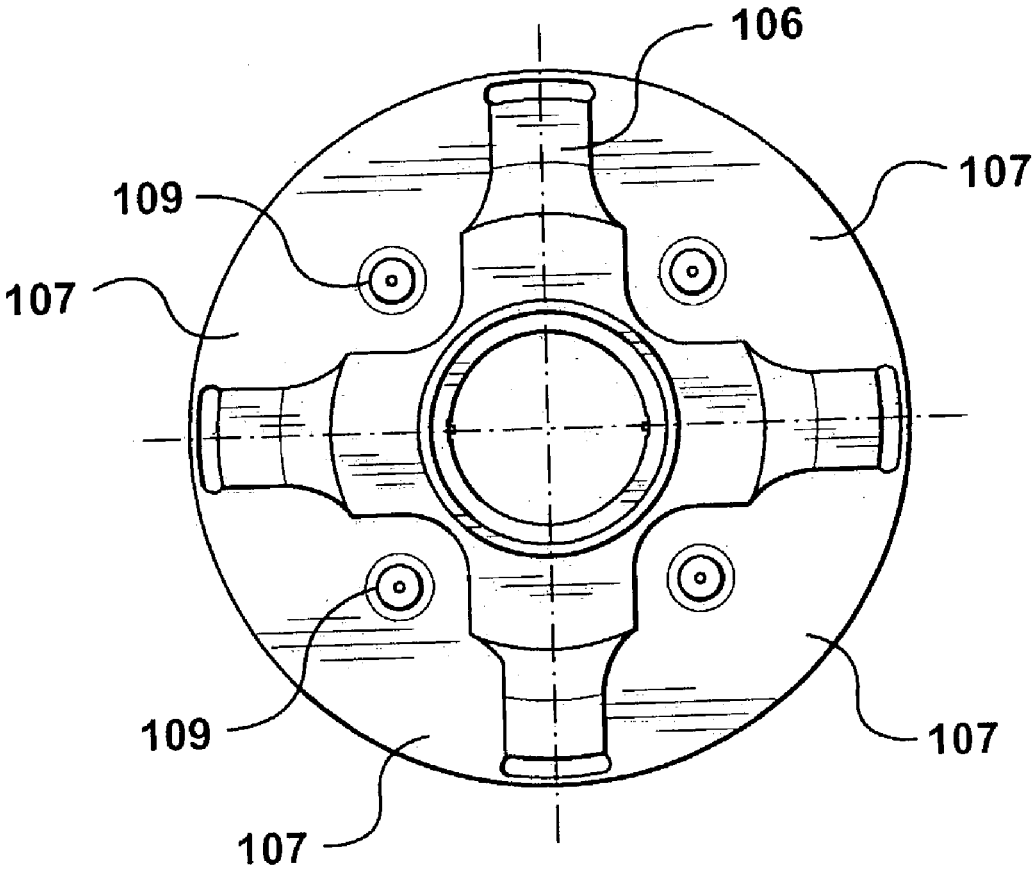

FIG. 7 is a top plan view of the support guide.

DESCRIPTION OF THE INVENTION

Like parts have the same number throughout the figures.

Figure 1:
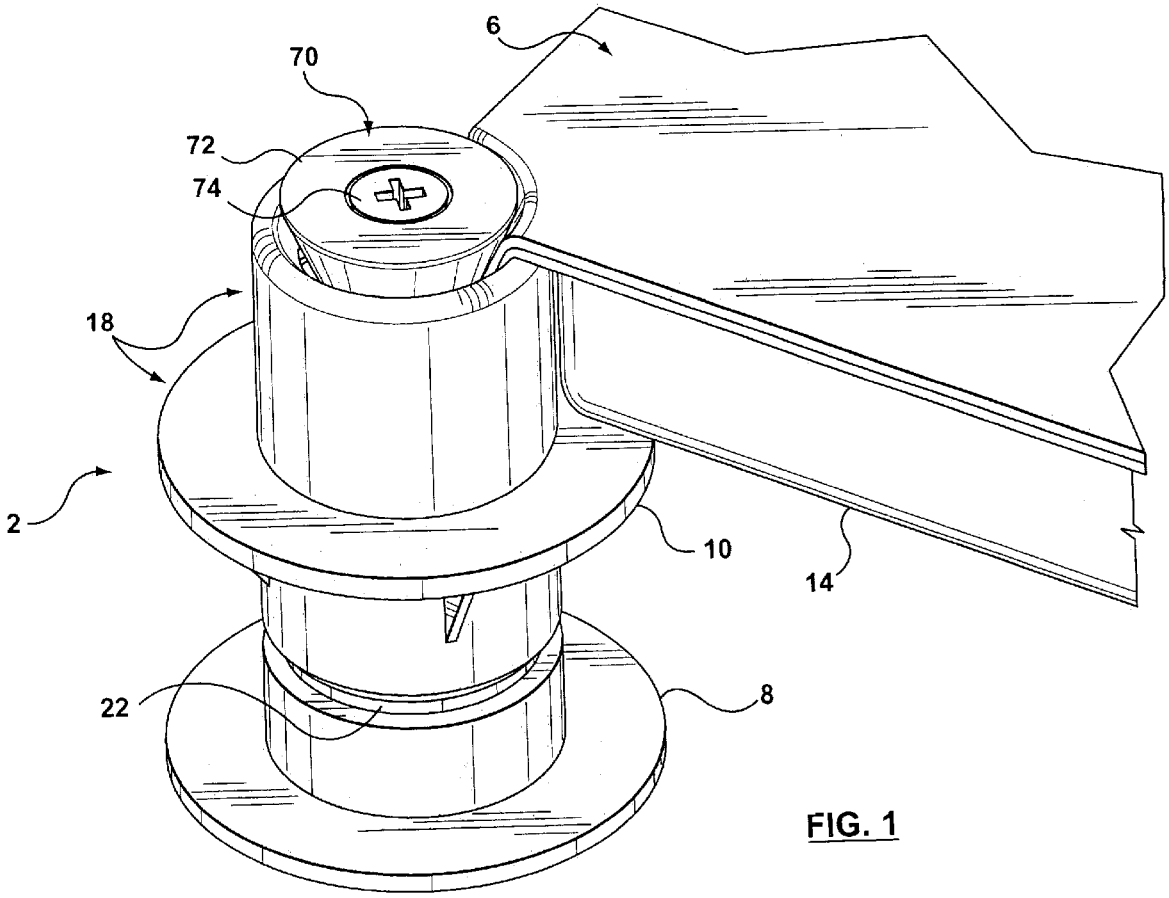
FIG. 1 is a perspective view of one embodiment of the invention.
Figure 2:
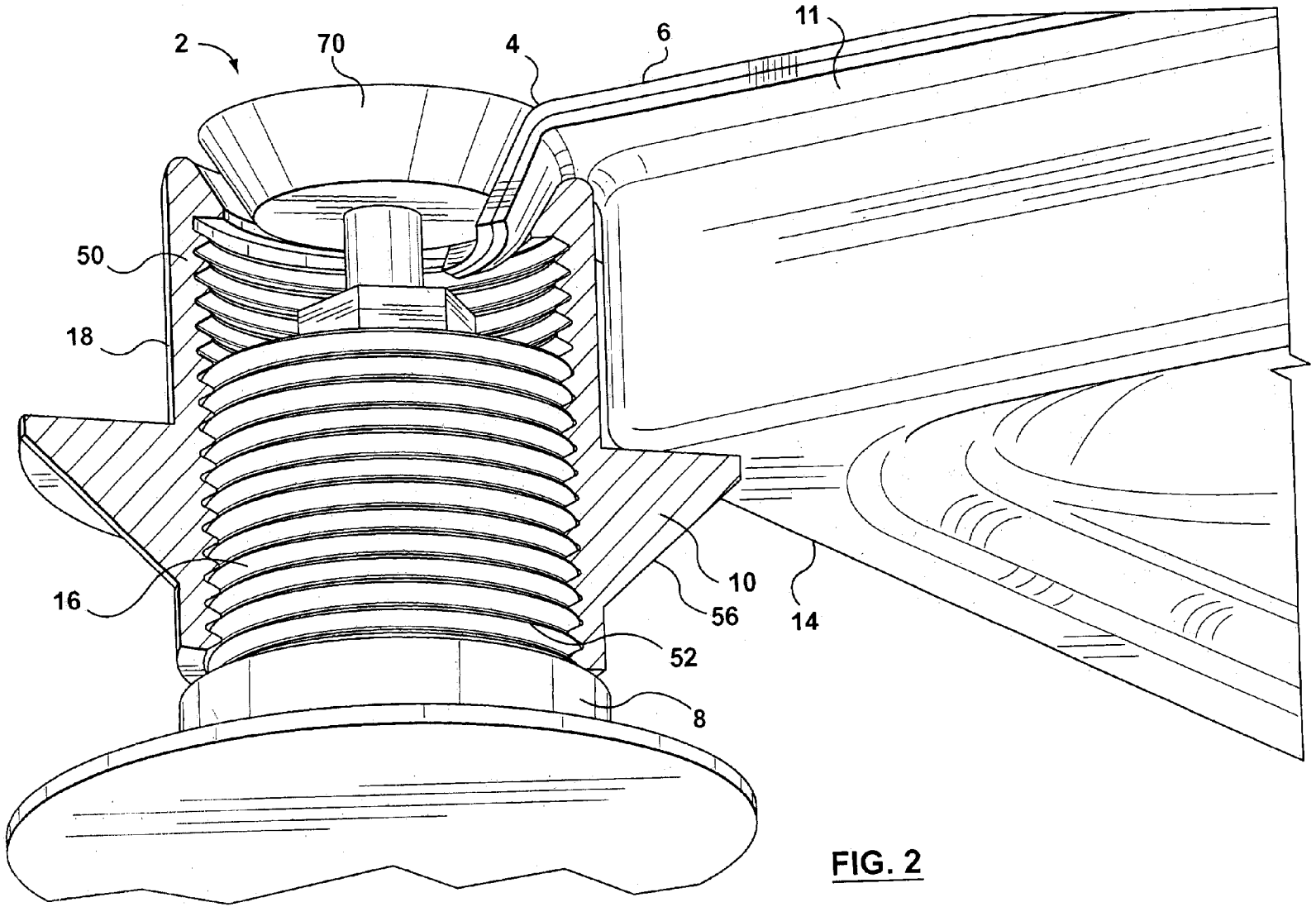
FIG. 2 is a partial cross section of the pedestal of FIG. 1.
Figure 3:
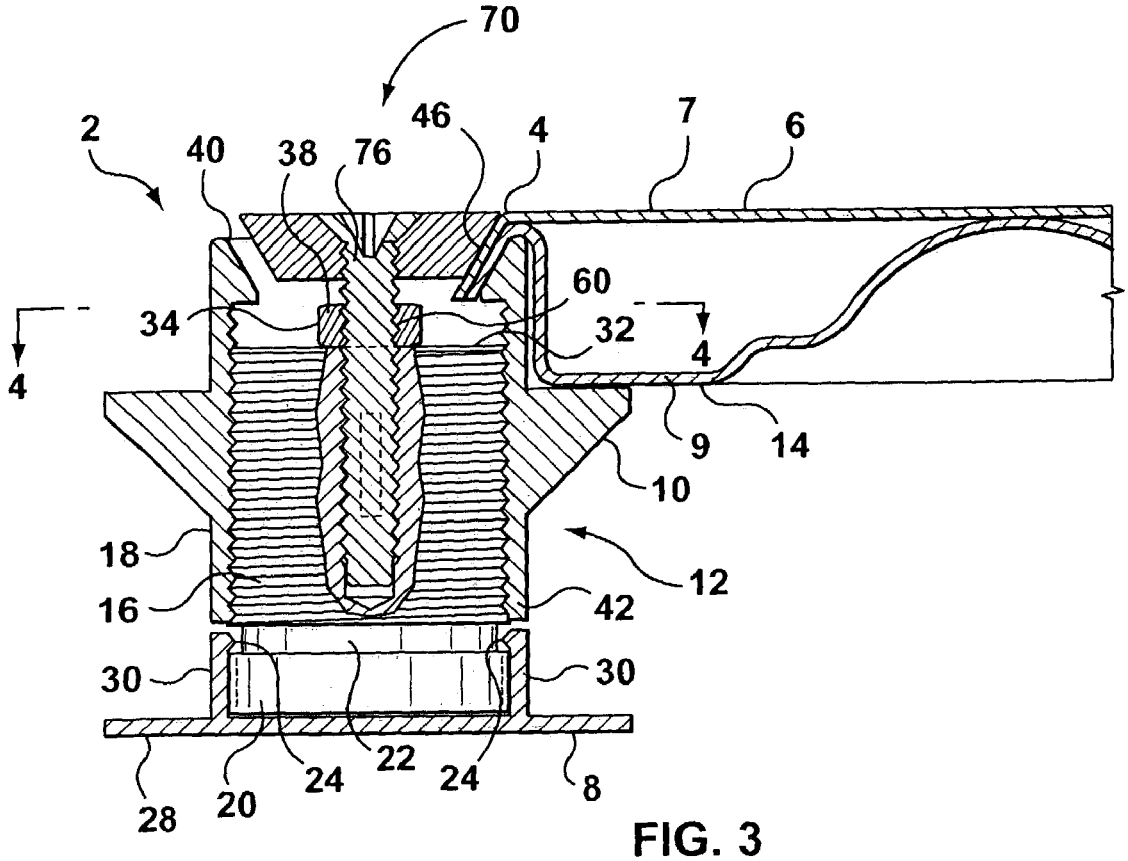
FIG. 3 is a full cross sectional view of the invention of FIG. 1 in a locked position.

One embodiment of the pedestal 2 is generally illustrated in FIGS. 1, 2 and 3. The pedestal 2 generally supports the corners 4 of the floor panels 6. Although the figures illustrate the corner 4 of one floor panel 6 the pedestal 2 will support four adjacent corners 4 of four panels 6 in a completed floor system.

The pedestal 2 generally consists of a base 8, a support or flange 10 and displaceable means 12. The support or flange 10 is adapted to support the lower edge 14 of the panel 6.

The displaceable means 12 generally consists of a first threaded member 16 and a second threaded member 18 engageable with the first threaded member 16 for selectively displacing the support 10 relative the base 8.

More particularly, the first threaded member 16 has one end 20 fixedly rotatable to the base 8. At the bottom of the first threaded member 16 there is a groove 22 that permits the base 8 to engage and affix to the groove 22. More specifically the base 8 includes projections 24 which are adapted to threadably spin the base 8 onto one end 26 of the first threaded member 16 until the projection 24 hits the groove 22. Thereafter the base 8 will freely turn but not fall off the pedestal 2 when the pedestal is lifted. Generally speaking the first threaded member 16 should preferably rotate relative the base 8 to prevent binding.

The base 8 can be made of a variety of materials including steel, aluminium, brass, bronze, plastic or the like and may be stamped, formed, or cast. The base 8 comprises of a flat bottom 28, which engages the building sub floor (not shown). The base 8 includes generally circular upstanding sidewalls 30 that encompass the one end 20 of first threaded member 16.

Another end 32 of the first threaded member 16 presents engageable means 34 which is adapted to be engageable with a tool (not shown) for rotating the first threaded member 16 relative the second threaded member 18 for selectively displacing the second threaded member 18 which in turn adjusts the height of the pedestal relative the base 8.

The second threaded member 18 generally consists of a cylindrically extending internally threaded tube 36 as shown in FIG. 3. The first threaded member 16 is telescopingly threaded to the interior threads of the second threaded member 18.

Accordingly, as the engageable means 34 is accessed by the tool (not shown) the engageable means 34 is rotated which causes the internal threaded member 16 to freely rotate about the base 8 since the projections 24 freely rotate within the groove 22. This action causes the second threaded member 18 to rise or fall in height relative the first threaded member 16 depending upon the direction of rotation. One embodiment of the invention consists of the engageable means comprising of a hexagonal head 38 which can be engageable which a hexagonal socket presented by a drill which is capable of being rotated in a clockwise or counter clockwise fashion.

The second threaded member 18 includes the outwardly extending support or flange 10.

The first threaded member 16, second threaded member 18 and base 8 are disposed generally co-axially. Upon operation of the displaceable means 12 the pedestal 2 axially increases or decreases in height.

The second threaded member 18 includes two open ends 40, 42. The top end 40 of the second threaded member 18 can be angled or bevelled to engage with the corner of floor panel 6. More specifically the corner 4 of the panel 6 includes a downwardly extending conical surface 46 which is adapted to contact the bevelled edge 40 of the second threaded member 18 which also supports the panel 6. Optimally speaking it is desirable that the bottom edge 14 of floor panel 6 be supported by the flange 10 simultaneously as the top conical surface 46 contacts the bevelled edge 40, although it is not essential. In other words, the bottom 14 may contact the flange 10 prior to the conical surface 46 contacting the bevelled edge 40.

The floor panel 6 can be made of stamped steel having an upper surface 7 and a lower surface 9, which is welded together and may be filled with cement or other material to add strength and sound dampening, or may be made of composites or laminates, like steel or wood in a manner well known to those skilled in the arts. The upper surface 7 as shown in FIG. 3 may extend slightly beyond the lower surface 9 to present an edge or lip 11, as seen in FIG. 2.

The corners 4 of the panel 6 may be moulded, stamped or formed on a curved or square angle disposed downward to mate with the top of the pedestal.

The open end 40 of second threaded member 18 generally includes the bevelled edge 40 which engages the angle formed into the corners 4 of floor panel 6. Accordingly the open end 40 of second threaded member 18 locates and positions the panels ready to be levelled.

The interior thread 50 of the second threaded member 18 is matched with the exterior thread 52 of first threaded member 16. In other words, the thread of 50 and 52 is either let hand or right hand.

The support or flange 10 is supported by a number of vertical ribs or gussets 56. The second threaded member 18 may comprise of materials similar to that of the first threaded member 16 described.

The height of the first threaded member 16 can vary to accommodate different heights of floors.

The engageable means also includes an internally threaded hole 60 which is adapted to receive locking means 70 for locking the floor panels 6 to the support 10 and inhibiting displacement of the displaceable means 12.

The locking means 12 in one embodiment consists of a clamp disc 72 which is adapted to lock the four panels 6 down at once as well as locking the pedestal 2 from turning.

More specifically, the clamp disc 72 includes a hole 74 adapted to receive a threaded bolt 76 engageable with the internally threaded hole 60. The threads of the internally threaded hole 60 and the thread bolt 76 is selected to be opposite to that of the threads 50 and 52 of the second threaded member 18 and the first threaded member 16. In other words, if the threads of the internally threaded hole 60 and the thread bolt 76 is right hand then the threads 50 and 52 are selected to be left handed so as to lock the first and second threaded members 16 and 18 and inhibit rotation.

Alternatively the locking means 70 may comprise of one piece presenting a clamping disc 72 and a clamping bolt 76. The locking means 70 includes threads which are opposite to the threads 50 and 52 so as to prevent rotation of the first threaded member 16 which controls the level of the finished floor.

The threaded bolt 76 must be long enough to engage the threaded hole 60. Although FIGS. 1, 2 and 3 illustrate various forms of screws and bolts, any type can be used having the intending purpose such as allen, Phillips, or other type. Moreover, although the invention is description in relation to a power drill, a hand screwdriver can also be used.

The invention described illustrates an access floor system that can be levelled after the panels 6 have been installed. This feature speeds up the levelling time by allowing of use of power tools to level as opposed to levelling under the pedestal head by fingers or wrenches. This feature allows for fine adjustment after the floor is installed.

The system described allows for an access floor to have a finished floor height as low as for example 2.5 inches to as high as necessary to accommodate customer requirements.

At present most access floor systems are adjusted from under the floor prior to panel installation. If further levelling is required the panels must be removed and adjustment made by hand. By levelling from the top using a tool the accuracy of the level can easily be made more accurate because of the ease of levelling; particularly when using laser beams.

A second embodiment of the invention is illustrated in FIGS. 5, 6 and 7 which includes a base 8, a first threaded member 16, a second threaded member 18 and locking means 70.

The base 8 includes a flat bottom 28 and circular upstanding side walls 30, having internal threads 31.

The first threaded member 18 consists of a generally cylindrical axially extending member 16 presenting exterior threads 52 along the length thereof. The threads 52 are selected to engage with the threads 31. The first threaded member 16 can be manipulated to travel from the lowest height LH to the highest height HH shown.

The upper end 33 of the first threaded member 16 may be bevelled. The first threaded member 16 may be solid or hollow and comprise of the materials previously discussed.

Furthermore, the base 8 may be round or square and comprise of the materials previously discussed.

The first threaded member 16 may be manipulated to a height required. Thereafter, a locking arm 80 may be rotated to bear against the upper portion 35 of the up standing sidewalls 30. The locking arm 80 presents an enlarged portion 32 having internal threads 83 engageable with the external threads 52. Once the locking arm 80 is engaged such arm 80 locks the height of the first threaded member 16 to a selected rough height above the base 8.

The second threaded member 18 comprises of a flange or support portion 10 having engageable means 34. The engageable means 34 comprises of a hexagonal head 38.

The second threaded member 18 includes internal threads 50 selected to engage the external threads 52. The second threaded member 18 may be stamped, formed, or welded as described before. The flange 10 may be circular or square as required.

The support means shown in FIGS. 5, 6 and 7 includes the support 10 and support guide 90 having a hole 92 therethrough between an upper surface 94 and lower surface 96. The lower surface 96 may include a plurality of ridges 98 which are adapted to rest against the upper surface 100 of support 10 to reduce friction.

The lower surface 96 of support guide 90 may include a skirt 102 extending axially beyond the support 10 to define a recess 104 for the reception of the second threaded member 18. The diameter of the hole 92 is slightly larger than the radial extent of the hexagonal head 38, to permit insertion of a tool as previously described.

The support guide 90 may be made of plastic or metal and adapted to receive floor panels 6. The floor panel 6 rests on the support guide 90 which locate the corners for four adjacent floor panels 6 for levelling and fastening. The support guide 90 can include vertical ribs 106 to separate the floor panels 6 into quadrants 107 and locate the floor panels 6 and prevent the support guide 90 from rotation. More specifically the quadrants 107 include locating fingers 109 which are adapted to be received in holes 113, located at the lower surface 9 of the floor panel 6 as best seen in FIG. 5*a*. The support guide 90 floats and slides as the second threaded member 18 is rotated to level the pedestal 2 by insertion of a tool as previously describe through the hole 96. The conical surface 46 extends into the hole 92 as shown. Once levelled a locking means 70 is utilized to lock the corners of the floor panels 6 as previously described.

The locking means 70 shown in FIGS. 5 and 6 consists of a generally cylindrical locking cap 71 co-axially mounted over the support guide 90, second threaded member 18, first threaded member 16 and base 8. The locking cap 71 includes internal threads 73 which are adapted to engage with the threads 52 of the first threaded member 16. The upper surface 75 of locking cap 71 may include engageable means such as a socket 73, namely a square hole engageable by a socket drive.

Figure 4:
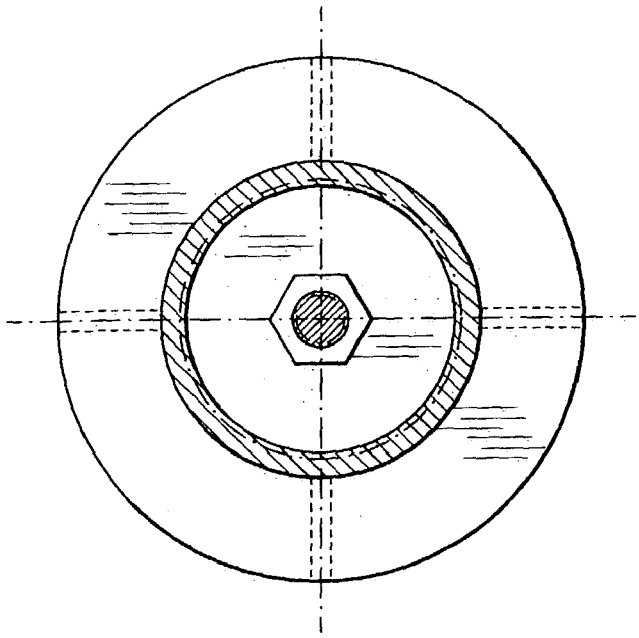
FIG. 4 is a top plan view of FIG. 3.

The corners 4 of the floor panels 6 of FIG. 4 may be bent and formed to a conical profile previously described that permits mechanical engagement to the locking cap 71.

The locking cap 71 threads over the first threaded member 16 to lock four adjacent floor panels 6 into place.

The locking cap can include a plurality of axially extending groves 117 which extend along a lower surface of the cap 71 as shown which are adapted to receive tapered protrusions 119 located in the hole 92 which assists in locating the locking cap 71 into hole 92 in pre-assembly but does not interfere with the locking function.

The second threaded member 18 includes the support or flange 10 having a nut or other adjusting device fastened, embossed or stamped to the top of the plate. This allows the flange 10 to be rotated by a tool as previously described to adjust the height of the floor panels 6. The center of the support 10 is threaded to accept and adjust on first threaded member 16.

The first threaded member 16 is stationary once locked by the locking arm 80 for fine adjustment from above floor panel 6; and adjusts in base 8 for rough pre-assembly height. The length of the first threaded member 16 may vary to allow for different floor heights.

The locking arm 80 projects beyond second threaded member 18 and allows for the locking of first threaded member 16 to the second threaded member 18 to inhibit rotation thereabouts. The threaded portion is either stamped, embossed or welded to the flat arm.

The invention described herein provides a method of levelling floor panels supported by pedestals at adjacent corners of said floor panels comprising of the steps of positioning said pedestals having telescoping threaded members at the corners of said adjacent floor panels for support said floor panels; accessing said telescoping threaded members by tools capable of threadedly adjusting the height of said telescoping threaded members from above said floor panels.

Although the preferred embodiment as well as the operation and use have been specifically described in relation to the drawings, it should be understood that variations in the preferred embodiment could be achieved by a person skilled in the trade without departing from the spirit of the invention as claimed herein.

The embodiments of the invention in which an exclusive property or privilege is claimed are defined as follows:

1. A pedestal adapted to support a floor panel comprising:
(a) a base;
(b) support means for supporting said floor panel above said base;
(c) first and second rotatable engageable members operable between said base and said support means for selectively displacing said support means and said floor panel relative said base so as to level said floor panel;
(d) said first rotatable engageable member engageable with said base for fixing said height of said first rotatable member relative said base;
(e) a locking means for:
(i) locking said floor panel to said support means; and
(ii) inhibiting displacement of said rotatable engageable members.

2. A pedestal as claimed in claim 1 wherein said rotatable engageable members comprise:
(a) a first threaded member;
(b) a second threaded member engageable with said first threaded member for selectively displacing said support means relative said base.

3. A pedestal as claimed in claim 2, wherein said first threaded member has:
(a) one end fixedly rotatable to said base,
(b) another end presenting engageable means for rotating said first threaded member relative said second threaded member for selectively displacing said support means relative said base.

4. A pedestal as claimed in claim 3 wherein said second threaded member includes said support means.

5. A pedestal as claimed in claim 4 wherein said support means includes a support surface extending generally outwardly for supporting said floor panel.

6. A pedestal as claimed in claim 5 wherein said first and second threaded members are both either left handed or right handed threads.

7. A pedestal as claimed in claim 6 wherein said locking means includes:
(a) an internally threaded locking hole presented at said other end of said first threaded member, and;

(b) an externally threaded bolt adapted for threaded engagement with said internally threaded locking hole; to;

(c) lock said floor panel to said support;

(d) inhibit displacement of said first and second threaded members.

8. A pedestal as claimed in claim 7 wherein said internally threaded locking hole and said externally threaded locking bolt are both the other one of said right handed or left handed threads.

9. A pedestal as claimed in claim 2 wherein said first threaded member has:

(a) one end threadably engageable with said base so as to adjust the height of said first threaded member relative said base;

(b) another end threadably engageable with said locking means;

(c) locking arm for locking said height of said first threaded member relative said base.

10. A pedestal as claimed in claim 9 wherein said second threaded member presents:

(a) said support means;

(b) engageable means for threadably rotating said support means relative said base.

11. A pedestal as claimed in claim 9 wherein said support means comprises:

(a) support member extending outwardly and presenting an internally threaded hole threadably engageable with said first threaded member, (b) a hexagonal head adapted for engagement for displacing said support member relative said first threaded member;

(c) a support guide resting on said support member for locating said floor panel, said support guide including a hole therethrough for receiving said hexagonal head and said other end of said first threaded member.

12. A pedestal for supporting the corners of adjacent floor panels comprising:

(a) a base;

(b) first and second threadably engageable members extending generally coaxially relative said base;

(c) one of said first and second threaded members including:

(i) a support extending generally radially outwardly for supporting said corners of said floor panels;

(ii) engageable means adapted for threaded rotation of said first threaded member relative said second threaded member so as to select the height of said support relative said base and level said floor panels while said floor panels are supported by said support;

(d) said first threaded member comprises of a generally cylindrical externally threaded first member having:

(i) one end connected to said base for relative rotation thereabouts;

(ii) another end presenting coaxially a hexagonal head accessible from above said floor panels;

(e) said second threaded member comprising a generally cylindrical internally threaded tube open at both ends and defining said second threaded member engageable with said externally threaded first member, said second threaded member presenting:

(i) a generally radially extending support for supporting a bottom corner of said floor panels;

(ii) a bevelled edge at said one open end adapted to engage an upper corner of said floor panels and permit access to said hexagonal head for rotation of said first threaded member relative said second threaded member to select the height of said support and said floor panels and level said floor panels from above said floor panels.

13. A pedestal as claimed in claim 12 including a locking means for:

(a) locking said floor panels to said support, and (b) wherein said upper surface of said floor panels have a turn down corner adapted to engage said bevelled edge.

14. A pedestal as claimed in claim 12 wherein:

(a) said base includes a threaded hole;

(b) said first threaded member comprises a generally cylindrical externally threaded first member having:

(i) one end threadably engageable with said threaded hole with said base for selecting the height of said first threaded member relative said base;

(ii) and another end;

(c) a locking arm for locking the selected height of said first threaded member relative said base;

(d) said second threaded member comprising a generally radially extending support adapted to support said bottom of said floor panels, and an internally threaded hole engageable with said externally threaded first member for selected axial displacement of said second threaded member relative said first member so as to adjust the height and level of said floor panels relative said base.

15. A pedestal as claimed in claim 14 including a locking means for locking said floor panels to said support, said locking means engageable with said another end of said first threaded member.

16. A pedestal as claimed in claim 1 wherein said first rotatable engageable member includes a groove and said base includes projections engageable with said grooves for fixing the height of said first rotatable engageable member relative said base.

17. A pedestal as claimed in claim 1 including a locking arm projecting beyond said second rotatable engageable member for locking said first rotatable engageable member with said base.

18. A pedestal for supporting the corners of adjacent floor panels comprising:

(a) a base;

(b) first and second threadably engageable members extending generally coaxially relative said base;

(c) said first threadably engageable member threadably engageable with said base;

(d) a locking arm engageable with said first threadably engageable member to lock said first threadably engageable member to said base, to a selected height above said base.

* * * * *